US009431722B2

(12) United States Patent
Lerchenmueller et al.

(10) Patent No.: US 9,431,722 B2
(45) Date of Patent: Aug. 30, 2016

(54) ELECTRICAL CONTACT SYSTEM FOR CONTACTING A COIL

(71) Applicant: Robert Bosch GmbH, Stuttgart (DE)

(72) Inventors: Klaus Lerchenmueller, Rettenberg (DE); Konstantin Lindenthal, Blaichach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/648,584

(22) PCT Filed: Oct. 4, 2013

(86) PCT No.: PCT/EP2013/070677
§ 371 (c)(1),
(2) Date: May 29, 2015

(87) PCT Pub. No.: WO2014/082776
PCT Pub. Date: Jun. 5, 2014

(65) Prior Publication Data

US 2015/0303591 A1 Oct. 22, 2015

(30) Foreign Application Priority Data

Nov. 29, 2012 (DE) ..... 10 2012 221 897

(51) Int. Cl.
*H01R 4/24* (2006.01)
*H01F 5/04* (2006.01)

(52) U.S. Cl.
CPC ..... *H01R 4/2416* (2013.01); *H01F 5/04* (2013.01)

(58) Field of Classification Search
CPC ..... H01R 4/2416; H01F 5/04
USPC ..... 439/417, 395, 391; 366/192, 107
See application file for complete search history.

(56) References Cited

U.S. PATENT DOCUMENTS 3,663,914 A * 5/1972 Lane ..... H01F 5/04 336/192
4,251,911 A 2/1981 Reynolds et al.
(Continued)

FOREIGN PATENT DOCUMENTS

DE 10323484 12/2004
DE 102004002935 8/2005
(Continued)

OTHER PUBLICATIONS

International Search Report for PCT/EP2013/070677, issued on Mar. 6, 2014.

*Primary Examiner* — Abdullah Riyami
*Assistant Examiner* — Nelson R Burgos-Guntin
(74) *Attorney, Agent, or Firm* — Norton Rose Fulbright US LLP

(57) ABSTRACT

An electrical contact system is provided for contacting a coil, in particular a coil of a rotational speed sensor, having: a holding body, the holding body being electrically insulated, a line segment, at least one electrical line, the electrical line being surrounded by an electrical insulating layer, at least one spring element, the at least one spring element being electrically conductive, the at least one spring element having at least one opening, the at least one opening forming a cutting edge in at least some regions of its edge, the at least one spring element being pressed with the at least one cutting edge against the line segment in such a way that the at least one cutting edge pierces through the electrical insulating layer and an electrical contact is produced between the at least one spring element and the at least one line segment.

11 Claims, 8 Drawing Sheets

(56) References Cited

U.S. PATENT DOCUMENTS 4,727,316 A * 2/1988 Shen ..... G01R 1/20 324/127
5,364,288 A 11/1994 Drewanz et al.
6,094,122 A * 7/2000 Sexton ..... H01R 13/187 336/90
6,233,502 B1 * 5/2001 Yim ..... H01L 12/24 336/225
6,252,482 B1 * 6/2001 Chiba ..... F02P 3/02 123/634
6,292,082 B1 * 9/2001 Vogel ..... F02P 3/02 336/107
6,437,674 B1 * 8/2002 Hamer ..... F02P 3/02 29/602.1
2006/0148338 A1 * 7/2006 Virchow ..... H01R 24/20 439/851
2008/0264397 A1 * 10/2008 Matsubayashi ..... H01F 38/12 123/634
2015/0233735 A1 * 8/2015 Lerchenmueller .. G01M 15/042 324/207.15
2015/0303591 A1 * 10/2015 Lerchenmueller ... H01R 4/2416 439/395
2016/0093954 A1 * 3/2016 Tabata ..... H01F 5/02 343/788

FOREIGN PATENT DOCUMENTS

DE 102009027853 1/2011
JP H 09-298071 A 11/1997
JP 2001-185251 A 8/2001
JP 2003124043 4/2003
WO WO95/10055 4/1995
WO WO2005/071700 8/2005
WO WO2009/013092 1/2009

* cited by examiner

ELECTRICAL CONTACT SYSTEM FOR CONTACTING A COIL

FIELD OF THE INVENTION

The present invention relates to an electrical contact system for contacting a coil, in particular a coil of a rotational speed sensor, and to the use of an electrical contact system in a rotational speed sensor for acquiring the rotational speed in an exhaust gas turbocharger.

BACKGROUND INFORMATION

Electrical coils are used in many industrial products. One possible application is for example the use of an electrical coil as a rotational speed sensor. In industrial applications, the available space for the installation of such electrical coils, in particular rotational speed sensors, is often small. It is therefore a technical challenge to accommodate the electrical coil, together with its electrical contacting, in the smallest constructive space and to ensure, over the lifespan of its use, a reliable electrical contact between the electrical terminals and the coil.

As a rule, electrical coils are made up of a defined number of windings of a wire around a holding body. As an electrical wire, frequently a thin metal wire is used, and particularly often so-called enameled copper wire is used. This electrical wire is surrounded by an electrically insulating layer of enamel, also referred to hereinafter as an insulating layer, in such a way that no electrical short-circuit arises between the wire windings that contact each other. The insulating layer used is often made up of a protective enamel that in many cases has a thickness of from 1 to 5 μm. In order to enable operation of the finished wound coil, the wire ends of the coil must be reliably electrically contacted, and for this purpose in particular the insulating layer has to be reliably penetrated. For this purpose, in many cases thermal contacting methods are used, such as welding or soldering.

Such thermal contacting methods require an additional working process that entails increased installation costs and process costs.

In addition, it is often difficult in the available narrow constructive space to ensure a reliable electrical contacting using the known thermal contacting methods.

German Published Patent Application No. 10 2004 002 935 describes an electrical connection system for producing an ignition coil that is intended to replace currently used contacting methods for connecting thin enameled wires in ignition coils with a so-called "cold" contacting. However, such an electrical connection system is preferably suitable for an end-face contacting.

SUMMARY

In comparison with the existing art, the electrical contact system for contacting a coil has the advantages that the contacting requires very little constructive space, and that it is also possible to reliably produce a plurality of different electrical contactings in different contact regions that are not situated at an end face of the holding body. In addition, equipment for thermal contacting processes can be done without. This yields significant cost advantages and space advantages in the design of the contacting of a coil.

According to the present invention, an electrical contact system is proposed for contacting a coil, in particular a coil of a rotational speed sensor, having the following components: a holding body, the holding body being electrically insulating, a line segment of at least one electrical line, the electrical line being surrounded by an electrical insulating layer, at least one spring element, the at least one spring element being electrically conductive, the spring element having at least one opening, the at least one opening forming a cutting edge in at least some regions of its edge. The at least one spring element is pressed with the at least one cutting edge against the line segment in such a way that the at least one cutting edge pierces through the electrical insulating layer, and an electrical contact is produced between the at least one spring element and the at least one line segment. According to the present invention, at least one bus bar is provided, the at least one bus bar being electrically conductive and the holding body and/or the at least one bus bar being provided with a clamping means, the bus bar being fixedly clamped on the holding body by the clamping means, and in this way the spring element being tensioned between the bus bar and a contact region of the holding body, and in this way the at least one line segment is electrically contacted with the at least one bus bar by the at least one spring element.

Particularly advantageous here is the possibility of fixedly clamping the bus bar on the holding body, using the clamping means, and in this way tensioning the spring element between the bus bar and the contact region of the holding body reliably over the entire lifespan of the system, and in this way producing a reliable electrical contact between the line segment and the bus bar. In addition, the clamping means advantageously make it possible for the bus bar also to be routed laterally along the holding body, so that it is also possible to produce a non-end-face cold contacting in a plurality of contact regions of the holding body, using a plurality of bus bars. In this way, such an electrical contact system can be produced in a particularly small constructive space.

In comparison with the existing art, the use of an electrical contact system in a rotational speed sensor for acquiring the rotational speed in an exhaust gas turbocharger has the advantage that, due to the particularly small design of the coil and of the electrical contact system, a rotational speed sensor can be produced that can be used even in the limited constructive space of an exhaust gas turbocharger housing, and that has a particularly good signal-noise ratio due to its compact design. In addition, the contact system according to the present invention is particularly suitable for ensuring, at low contacting costs, a reliable contacting of the rotational speed sensor in the exhaust gas turbocharger over its entire lifespan, and in all operating states of the exhaust gas turbocharger. In this way, there result significant cost advantages, while the lifespan of the rotational speed sensor remains at least the same.

Due to the fact that the at least one spring element is made, as a flexible spring, from a metal strip, and that the at least one spring element immediately electrically contacts at least one bus bar, it is advantageously achieved that the spring element has a particularly flat construction and, in the mounted state, comes to be seated in a plane between the bus bar and the holding body that is substantially parallel to the plane of the bus bar and to the plane of the holding body. In addition, the use of a flexible spring ensures a reliable contacting, due to the spacing tolerance compensation brought about by the spring element, even when there are changes in the spacing between the bus bar and the holding body, for example as a result of thermal or mechanical stress.

An advantageous development of the electrical contact system provides that the at least one bus bar is detachably connected to the holding body. In this way it is advantageously brought about that the bus bar can be mounted particularly easily, and that the bus bar can be exchanged particularly easily during maintenance work.

An advantageous development of the electrical contact system provides that the contacting region has a snap indentation opening having at least one snap indentation, and that the at least one spring element has a spring element snap nose, and that the at least one spring element engages, via the at least one spring element snap nose, in the snap indentation opening, and grasps the at least one snap indentation. This advantageously brings it about that the spring element is fastened on the holding body in a captive manner secure against slippage, and that the mounting process can in this way advantageously be simplified.

Due to the fact that the at least one bus bar engages at the end in a recess of the at least one spring element, forming a pivot bearing for the at least one bus bar, it is advantageously achieved that the bus bar can be mounted and fixed on the holding body particularly simply. In addition, it is advantageously achieved that the connection between the spring element and the bus bar is permanently ensured over the lifetime of the electrical contact system, and is substantially not impaired by aging processes of the material.

An advantageous development of the electrical contact system provides that the clamping means on the holding body is fashioned as at least one pin, there being fashioned in the at least one bus bar at least one socket-type opening such that the at least one pin is accommodated in the at least one socket-type opening, forming a non-positive connection between the at least one pin and the at least one socket-type opening. The realization of the clamping means as a pin and socket-type opening advantageously brings about a particularly simple and secure mounting of the bus bar on the holding body. In addition, if more than one pin and more than one socket-type opening are used, a precise positioning and orientation of the bus bar relative to the holding body is advantageously brought about.

Due to the fact that the at least one spring element has at least one flexible clip, the at least one flexible clip being bent around the at least one bus bar in such a way that the at least one spring element is fastened on the at least one bus bar, it is advantageously brought about that the bus bar and the spring element form a mounting unit, making the mounting of the electrical contact system particularly simple. Moreover, in this way it is advantageously brought about that the electrical contact between the spring element and the bus bar is permanently ensured. Finally, in this way it is advantageously brought about that the winding process during the production of the coil on the holding body can be carried out easily, because, other than the holding body and the enameled copper wire for the coil, no moving parts are present that could become detached during the winding process or that could cause an imbalance during the winding process.

A further exemplary embodiment of the electrical contact system provides that the at least one spring element has two clamping arms at a distance from the holding body that at least in some regions surround the holding body in the contact region, the clamping arms having spring clips on their ends, and the at least one bus bar having two clamping jaws extending toward the holding body, and that the at least one bus bar is pushed, with its clamping jaws, over the clamping arms of the at least one spring element in such a way that the spring clips are tensioned between the clamping jaws and the holding body. This development advantageously brings about a particularly simple mounting and particularly reliable contacting of the coil.

DETAILED DESCRIPTION

Figure 1A:
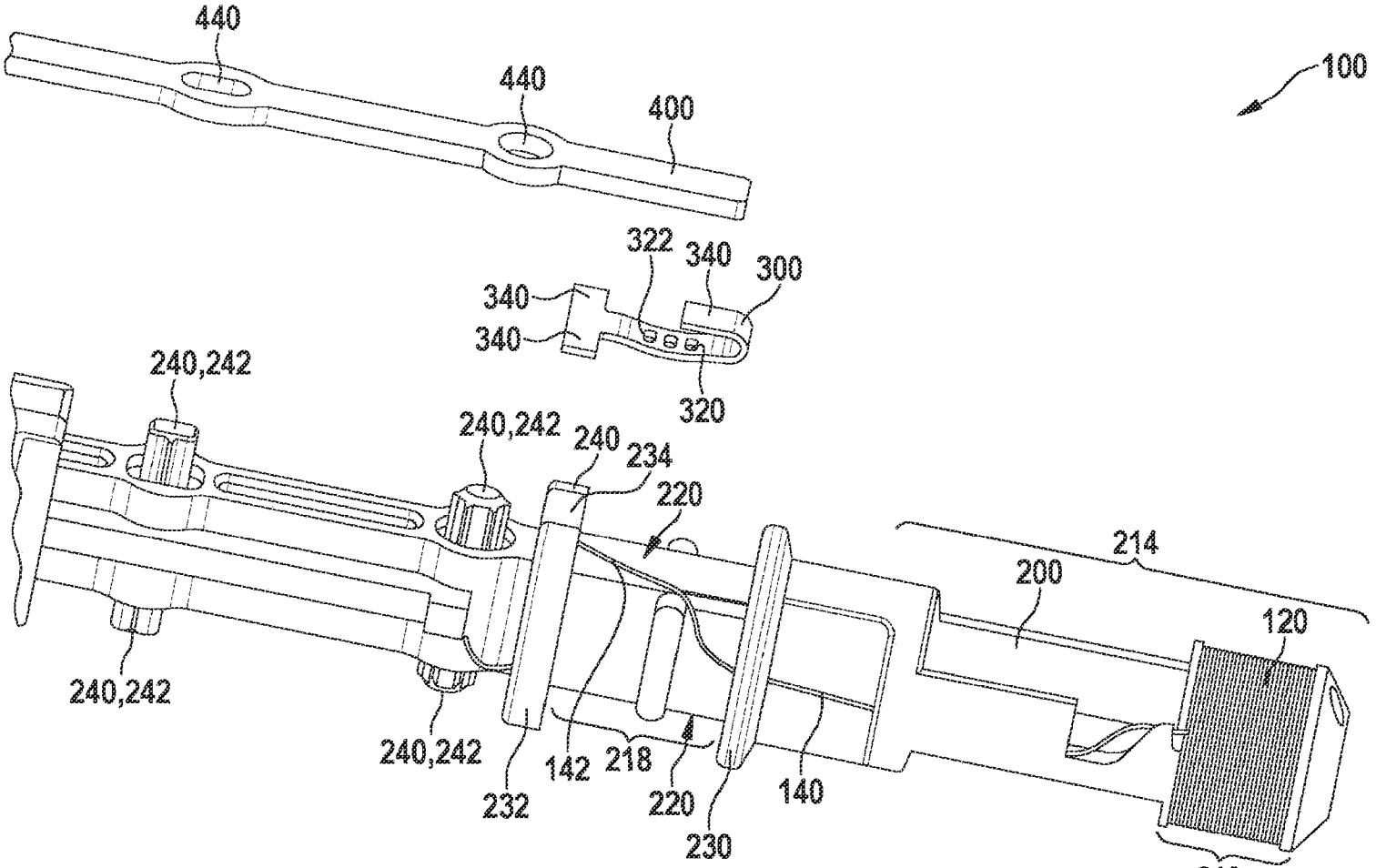
FIG. 1*a* shows an exploded view of an electrical contact system according to the present invention for contacting a coil, according to a first exemplary embodiment.

FIG. 1*a* shows an electrical contact system 100 for contacting a coil 120, in particular a coil 120 of a rotational speed sensor. Electrical coil 120 is formed by windings of an electrical line 140 around a holding body 200. Electrical line 140 is preferably made of enameled copper wire, i.e. thin copper wire surrounded by an electrically insulating layer of insulation. The layer of insulation is preferably made of a thin layer of enamel having a thickness of 1 to 5 μm. The insulating layer is necessary in order to prevent electrical short circuits within the wound coil body, thus enabling a tight winding of coil 120. Coil 120 is electrically contacted via two wire ends that protrude from the coil body. In the depicted exemplary embodiment, electrical coil 120 is wound onto a winding segment 210 of holding body 200 situated at the end of holding body 200, and is preferably used as a rotational speed sensor for an exhaust gas turbocharger.

Holding body 200 is made up of an electrically insulating material, preferably plastic. Holding body 200 has, seen from winding region 210 of coil 120, first a substantially round or elliptical cross-section along an end region 214 that is particularly suitable for winding on coil 120. As it continues further, at the end of end region 214 a first collar 230 is formed. Along the longitudinal axis, behind first collar 230 there follows a contact segment 218. In this exemplary embodiment, in contact segment 218 the cross-section of holding body 200 is substantially rectangular, the surface of holding body 200 in contact segment 218 having two planar surfaces situated on opposite sides, each forming a contact region 220. As holding body 200 continues, there follows a second collar 232 that runs around holding body 200, coinciding approximately with the end of contact region 220 and having, in a prolongation of contact region 220, a collar opening 234 that can also act as clamping means 240. Behind this second collar 232, pins 242, acting as clamping means 240, are fashioned on holding body 200, two pins 242 being fashioned on each side of holding body 200 on which a contact region 220 is situated. In other specific embodiments, however, only one pin 242 may be fashioned, or more than two pins 242 may be fashioned on each side of a contact region 220.

Electrical line 140 that is to be contacted is guided from winding region 210 of coil 120 along end region 214 of holding body 200 in contact region 220 of holding body 200.

Electrical contacting device 100 additionally has a spring element 300 that has a T-shaped design, the three T ends of spring element 300 being fashioned as flexible clips 340. In the depicted exemplary embodiment, three openings 320 are situated in spring element 300. Openings 320 are fashioned substantially orthogonal to the longitudinal axis of spring element 300. Edges 320 are each fashioned as cutting edge 322. Line segment 142 provided with the insulating layer here stands in mechanical contact to openings 320, with their cutting edges 322. When spring element 300 is loaded with a mechanical pressure, at least one cutting edge 322 breaks through the insulating layer of electrical line 140. This forms a mechanical and electrical contact between electrical line 140, preferably fashioned as an enameled copper wire, and electrically conductive spring element 300.

In addition, the electrical contact system has a bus bar 400 that has an oblong basic body running in a direction of longitudinal extension, the basic body having a substantially rectangular cross-section and being provided with socket-type openings 440, the socket-type openings 440 being fashioned so that they can be fitted onto pins 242 of the holding body with a press fit. Bus bar 400 is particularly preferably made of an electrically conductive material, particularly preferably a metal. Bus bar 400 is constructively designed such that, in the mounted state, it has adequate bending rigidity to be able to permanently hold spring element 300 against holding body 200 with tension.

In the perspective view, shown in FIG. 1*a*, of contact system 100, on the underside two pins 242 acting as clamping means 240 are visible. These pins are used to attach a further bus bar 400 (not shown in the Figure) that is suitable for contacting another wire end, of a further line segment 142, of coil 120 using a second spring element 300 (also not shown here).

Figure 1B:
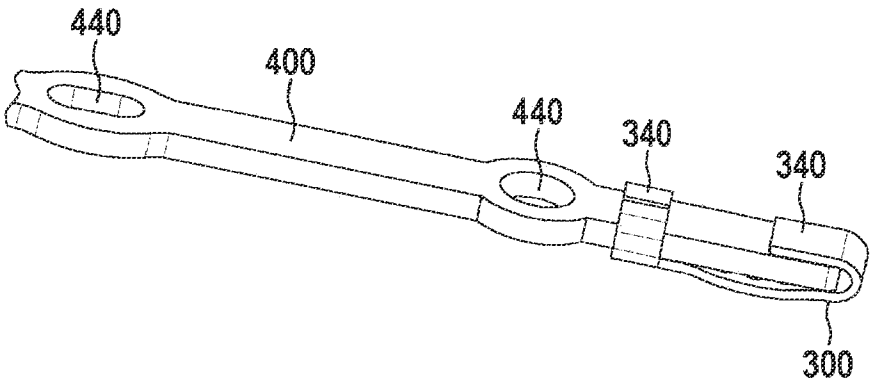
FIG. 1*b* shows a detail of the electrical contact system of FIG. 1*a*.

In FIG. 1*b*, bus bar 400 is shown with spring element 300 fastened thereto by flexible clips 340. Flexible clips 340 are bent around bus bar 400 in such a way that spring element 300 is fixedly connected mechanically and electrically to bus bar 400. As is shown in FIG. 1*b*, in the region of openings 320 spring element 300 has the shape of a plate spring. The region in which openings 320 are situated protrudes from the plane of bus bar 400, so that when pressure is applied to the region having openings 320, spring element 300 is pressed in the direction of bus bar 400, and in this way is tensioned.

Figure 1C:
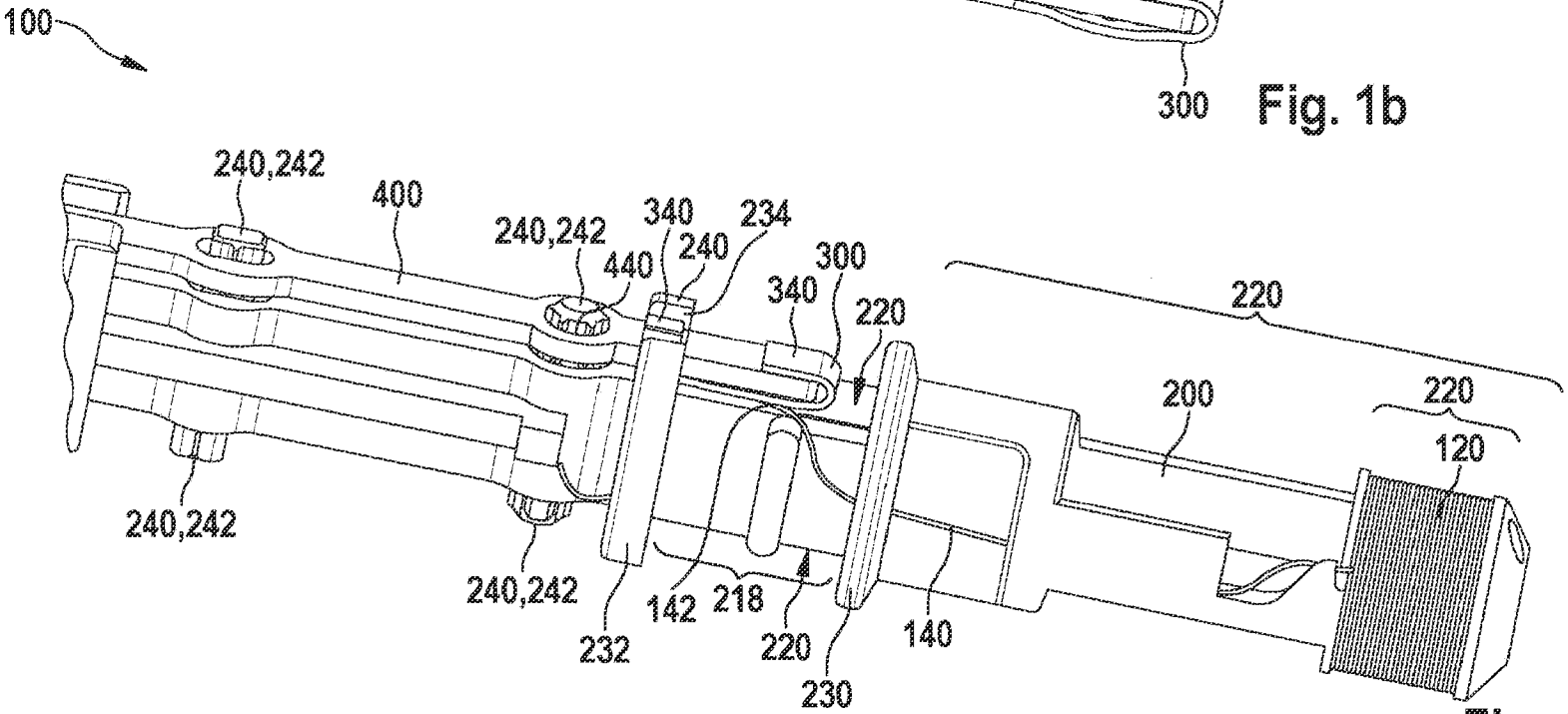
FIG. 1*c* shows a perspective view of the electrical contact system for contacting a coil in the mounted state according to FIG. 1*a*.

FIG. 1*c* shows electrical contact system 100 of FIG. 1*a* in the finally mounted state. Here, pins 242, fashioned as clamping means 240, of holding body 200 are guided through socket-type openings 440 of bus bar 400. Pins 242 are made in such a way that a non-positive connection exists between at least one of the two pins 242 and one of the socket-type openings 440, through which connection bus bar 400 is fixedly connected to holding body 200. In order to enable the non-positive connection between a pin 242 and a socket-type opening 440, pin 242 can have a stelliform cross-section in which the distance from the pin center to the vertices is preferably somewhat greater than the distance between the center of socket-type opening 440 and the edge of second-type opening 440, so that the bus bar has to be pressed onto pins 242. However, other cross-sectional shapes of pin 242 are conceivable that ensure a reliable non-positive connection between pin 242 and socket-type opening 440 of bus bar 400.

Through the clamping of bus bar 400 on holding body 200, spring element 300 is tensioned between bus bar 400 and holding body 200 in the region of its openings 320. Spring element 300 here operates in the manner of a plate spring. In the depicted exemplary embodiment, line segment 142 comes to be seated between holding body 200 and spring element 300. Openings 320 of spring element 300 are here situated over line segment 142. When bus bar 400 is fixed on holding body 200, the insulating layer of line segment 142 is penetrated at least in the region of cutting edges 322 of spring element 300, by cutting edges 322 on the edges of openings 320, causing the spring element to come into direct mechanical and electrical contact with line segment 142. The electrical contact produced in this way between bus bar 400 via spring element 300 and line segment 142 and conducting wire 140 to coil 120 can thus be produced by a simple mechanical mounting process, without thermal action. The electrical contact between spring element 300 and line segment 142 is moreover also permanently ensured, because bus bar 400 is securely fixed on pin 242 by socket-type openings 440, and, through its spring force, spring element 300 tensioned between bus bar 400 and holding body 200 compensates differences in spacing, resulting from production, between bus bar 400 and holding body 200. Such differences in spacing can be caused by aging effects of the materials, or can be caused by mechanical and/or thermal stress.

The specific embodiment shown in FIGS. 1*a* through 1*c* enables a particularly secure and reliable winding of coil 120 on winding segment 210 of holding body 200, because during the winding process, apart from electrical line 140 fashioned as coil wire and holding body 200, no further mechanical parts are involved, and in this way mechanical imbalances during the winding process can be avoided to the greatest possible extent.

Holding body 200 shown in FIGS. 1*a* and 1*c* has, along its longitudinal direction, two collars 230, 232, i.e. elements that are shield-shaped and that in the exemplary embodiment are situated at a distance from one another, protruding past the normal diameter of holding body 200. The two collars 230, 232 are fashioned such that when holding body 200, preferably acting as a rotational speed sensor, is inserted into a rotational speed sensor sleeve, they act as a radial guide for holding body 200, which extends in oblong fashion. In this way they perform a plurality of functions: on the one hand, they counteract tilting of holding body 200 in the sleeve during insertion, thereby achieving in a reliable and secure manner that coil 120, acting as rotational speed sensor element or detector coil, can be brought to a stop at the front end of the sleeve, and can thus be brought to be situated at a well-defined distance from the at least one rotating element whose rotational speed is to be acquired. On the other hand, collars 230, 232 ensure that holding body 200, while being mounted, before installation or during insertion into the sleeve of a rotational speed sensor, does not come to lie directly on electrical line 140 or on line segment 142, undesirably cutting through the insulating layer. Collars 230, 232 thus act as handling protection against mechanical defects at the conducting wire and/or at holding body 200, and/or at bus bar 400. In the region of bus bar 400, second collar 232 has an opening that can act as an introduction guide during mounting of bus bar 400 onto pins 242, and as a clamping means relative to bus bar 400.

Figure 2A:
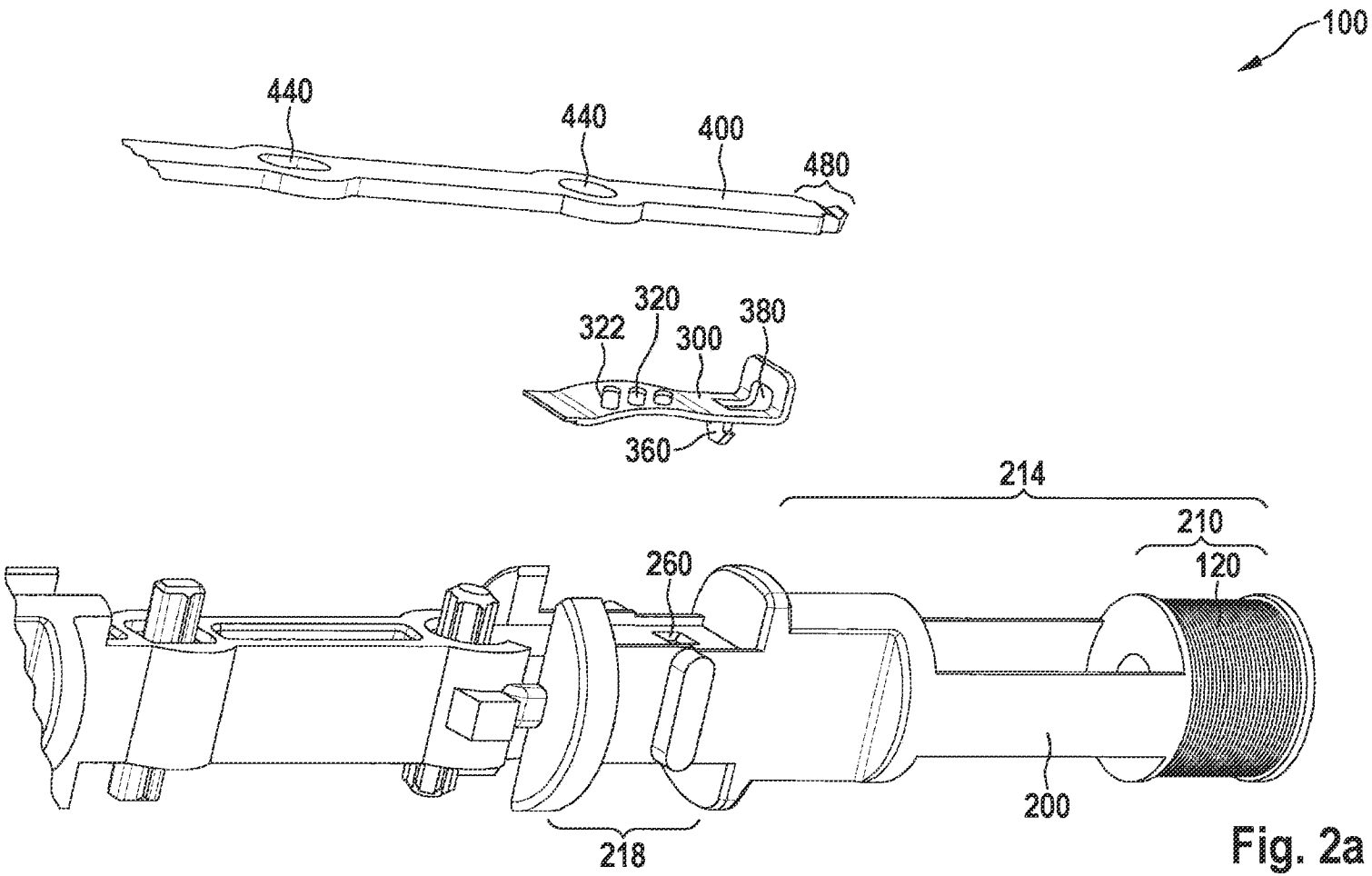
FIG. 2*a* shows an exploded view of an electrical contact system according to the present invention for contacting a coil according to a second exemplary embodiment.

FIG. 2*a* shows an exploded view of a second specific embodiment of a contact system 100 according to the present invention for contacting a coil 120. In this specific embodiment, holding body 200 has in its contacting region a snap indentation opening 260 in which a snap indentation 262 (shown in detail in FIG. 2*d*) is situated. Spring element 300 is fashioned as a metallic stamped flexible part, and has, next to openings 320 situated, in this exemplary embodiment, oblique to the main axis of spring element 300, with their cutting edges 322, a spring element locking nose 360 that is suitable for snapping into snap indentation 262 of snap indentation opening 260 of holding body 200. For this purpose, spring element snap nose 360 is bent downward extending out from spring element 300. In addition, spring element 300 has, at one of its ends, an upwardly bent region in which there is an opening 380. In addition to its socket-type openings 440, bus bar 400 has a pivot bearing end region 480 that is fashioned such that it can engage in opening 380 of the spring element so as to form a pivot bearing 450.

Figure 2B:
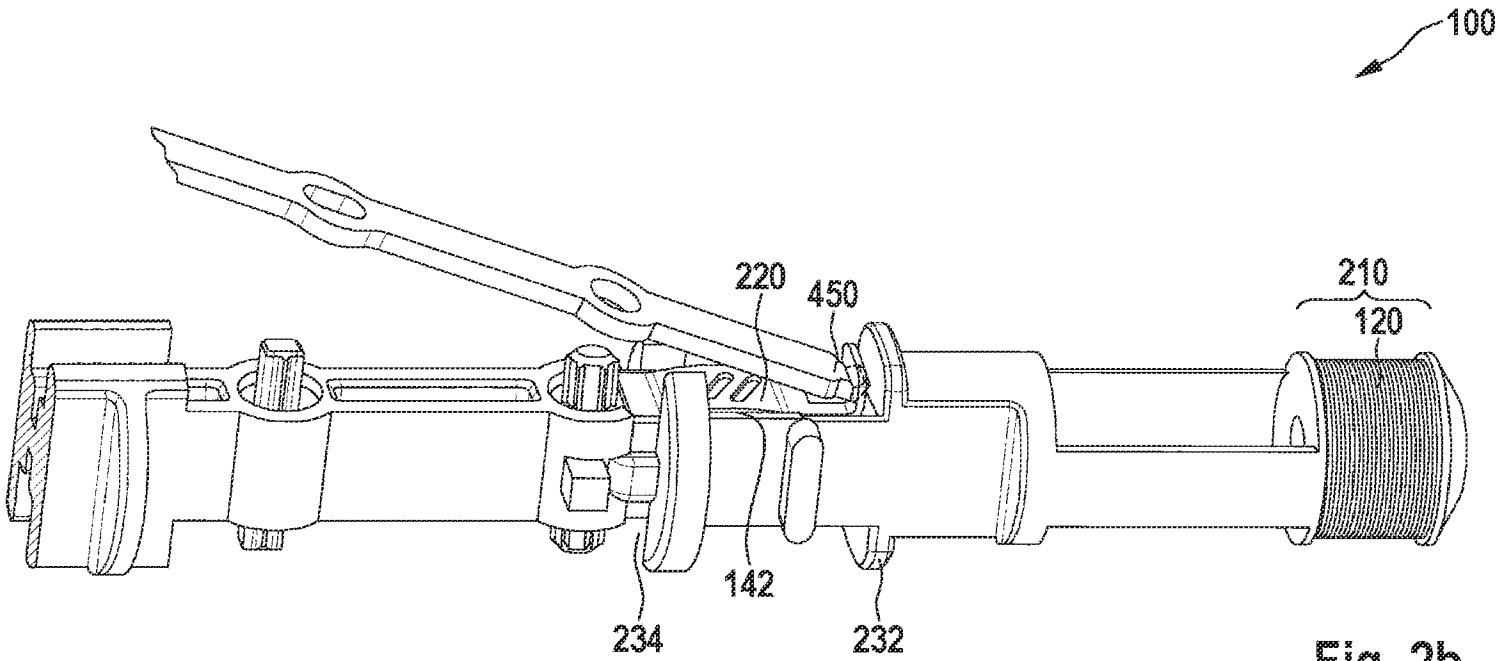
FIG. 2*b* shows a perspective view of the electrical contact system of FIG. 2*a* during a mounting step.

FIG. 2*b* shows the mounting process of the specific embodiment of electrical contact system 100 of FIG. 2*a*. First, spring element 300 is fixed on snap indentation 262 of snap indentation opening 260 of holding body 200, using spring element snap nose 360. Subsequently, coil 120 is wound onto holding body 200 in winding segment 210 of holding body 200, and the coil wire ends, acting as line segment 142, are guided into contact region 220 in such a way that they come to lie on spring element 300, fastened by spring element snap nose 360, and here they lie at least in some regions over openings 320 with their cutting edges 322.

Figure 2C:
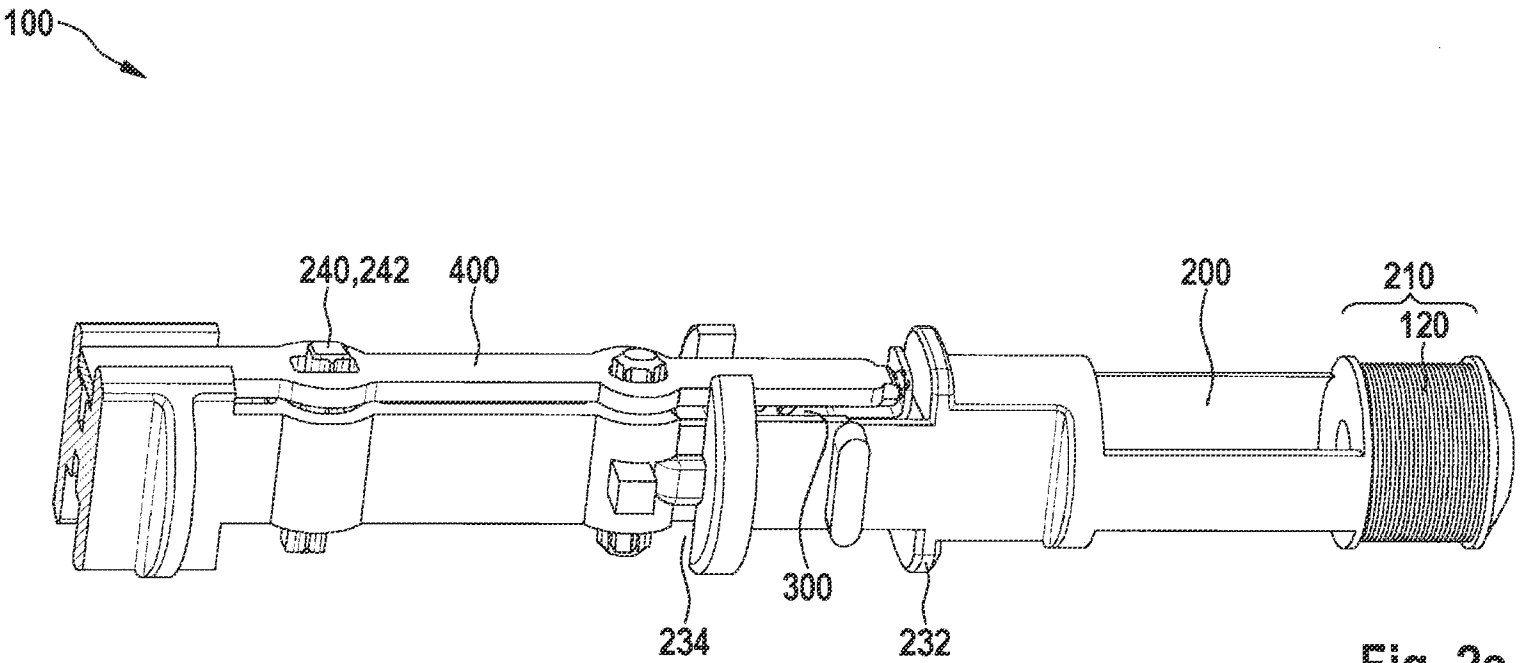
FIG. 2*c* shows the electrical contact system for contacting a coil of FIG. 2*a*, in the finally mounted state.

FIG. 2*c* shows the finally mounted state of the specific embodiment of electrical contact system 100 shown in FIGS. 2*a* and 2*b*. Here, line segment 142 is situated between bus bar 400 and spring element 300. Through the clamping of bus bar 400 on holding body 200, plate spring-type spring element 300 is tensioned, and cutting edges 322 pierce the insulating layer of line segment 142 of the coil wire. In this way, a reliable and secure mechanical and electrical contact is produced between bus bar 400 and line segment 142, and thus coil 120. Pivot bearing 450 enables a particularly reliable mounting of bus bar 400 with its socket-type openings 440 onto pins 242. In addition, the connection of metallic bus bar 400 by its pivot bearer end region 480 in opening 380 of spring element 300 ensures a particularly reliable and permanent contacting between bus bar 400 and line segment 142. This is because this metal-metal connection between bus bar 400 and spring element 300, and line segment 142 situated between them, is exposed to fewer mechanical alterations due to age and stress than is for example a plastic-metal connection.

Figure 2D:
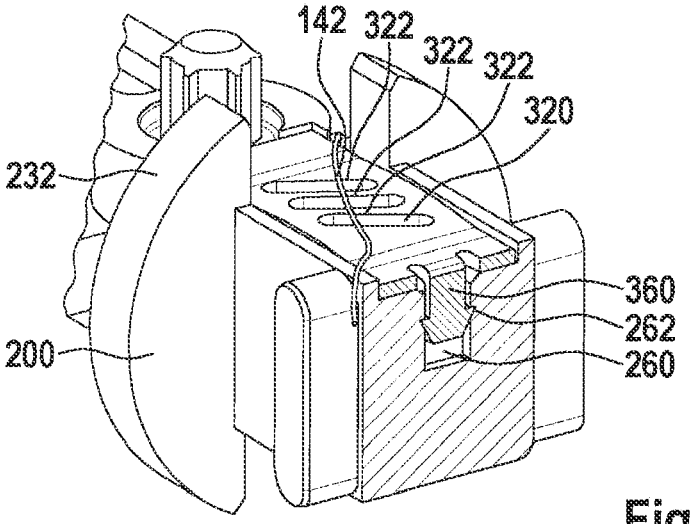
FIG. 2*d* shows a perspective view of a cross-section through the holding body of FIGS. 2*a* to 2*c*, in the region of the snap indentation opening.

FIG. 2*d* shows a cross-section of holding body 200 in the region of snap indentation opening 260 of contact region 220. Spring element snap nose 360 of spring element 300 grasps snap indentation 262, whereby spring element 300 is securely and reliably fixed on holding body 200. Here, spring element snap nose 360 can be fashioned as a hook-shaped element that is pressed into the material of holding body 200 in snap indentation 262. In FIG. 2*d* it can also be seen how line segment 142 runs over openings 320 with its cutting edges 322 of spring element 300, spring element 300 still having, in the depicted detail, the plate spring-type curvature of its untensioned state. Due to the mechanical movement of spring element 300 during the clamping of bus bar 400, in the region of openings 300 there results a vertical and lateral movement of opening 320 and its cutting edges 322 relative to line segment 142, whereby the insulating layer of line segment 142 is reliably pierced, and spring element 300 reliably electrically contacts line segment 142.

Figure 3A:
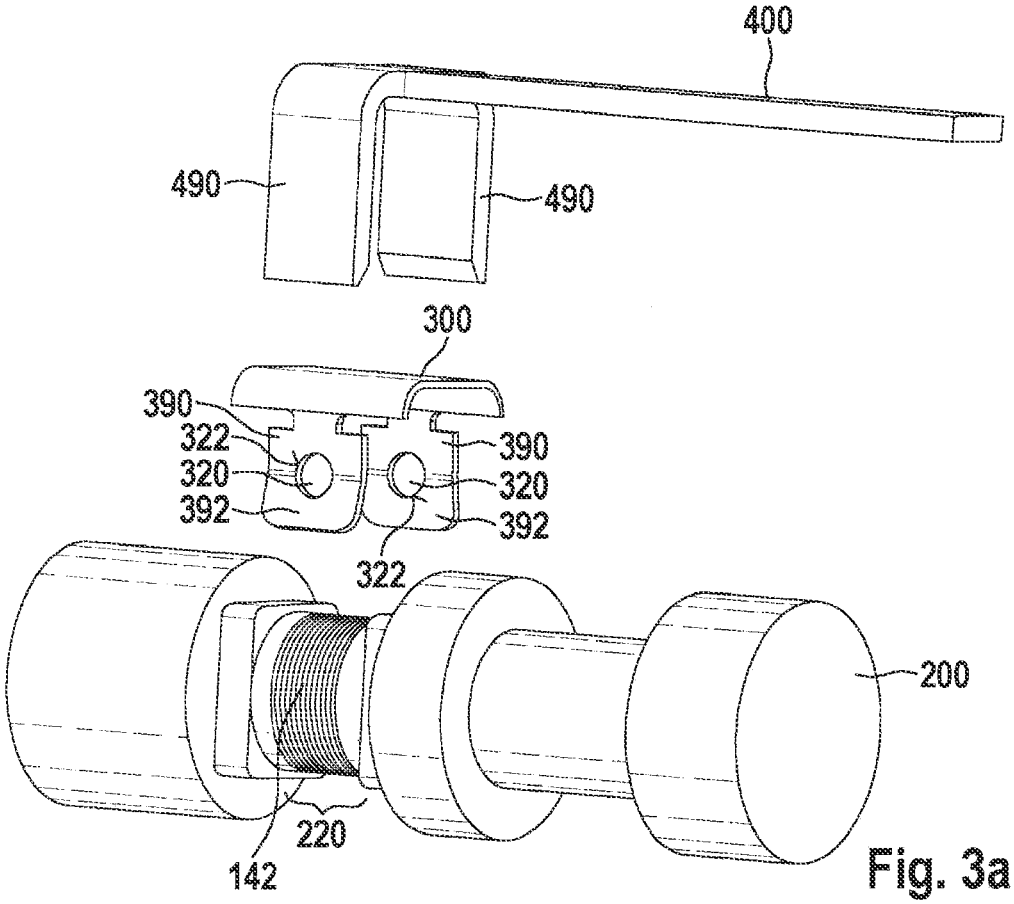
FIG. 3*a* shows a perspective exploded view of a contact system according to the present invention for contacting an electrical coil according to a third exemplary embodiment.

FIG. 3*a* shows an exploded view of a third exemplary embodiment. Here, line segment 142 is wound in a plurality of windings around holding body 200 in contact region 220 of holding body 200. Contact region 220 of holding body 200 has a substantially round cross-section. Spring element 300 has two clamping arms 390 that stand out in U-shaped fashion toward holding body 200, substantially circular round openings 320, having cutting edges 322 fashioned at the edge, being fashioned in clamping arms 390. At the end of clamping arms 390 there are situated spring clips 392 that stand out slightly from the plane of clamping arms 390. Clamping arms 390 are substantially rectangular and have at least partly rounded edges. The spacing of the two clamping arms 390 is made such that spring element 300 can easily be pushed over line segment 142 fashioned as coil element. On bus bar 400, on its end facing spring element 300 there are fashioned two clamping jaws 490 standing out toward holding body 200, clamping jaws 490 having a U-shape similar to clamping arms 390 of spring element 300. Here, together with clamping jaws 490, clamping arms 390 form the clamping means by which bus bar 400 is fixed on holding body 200.

Figure 3B:
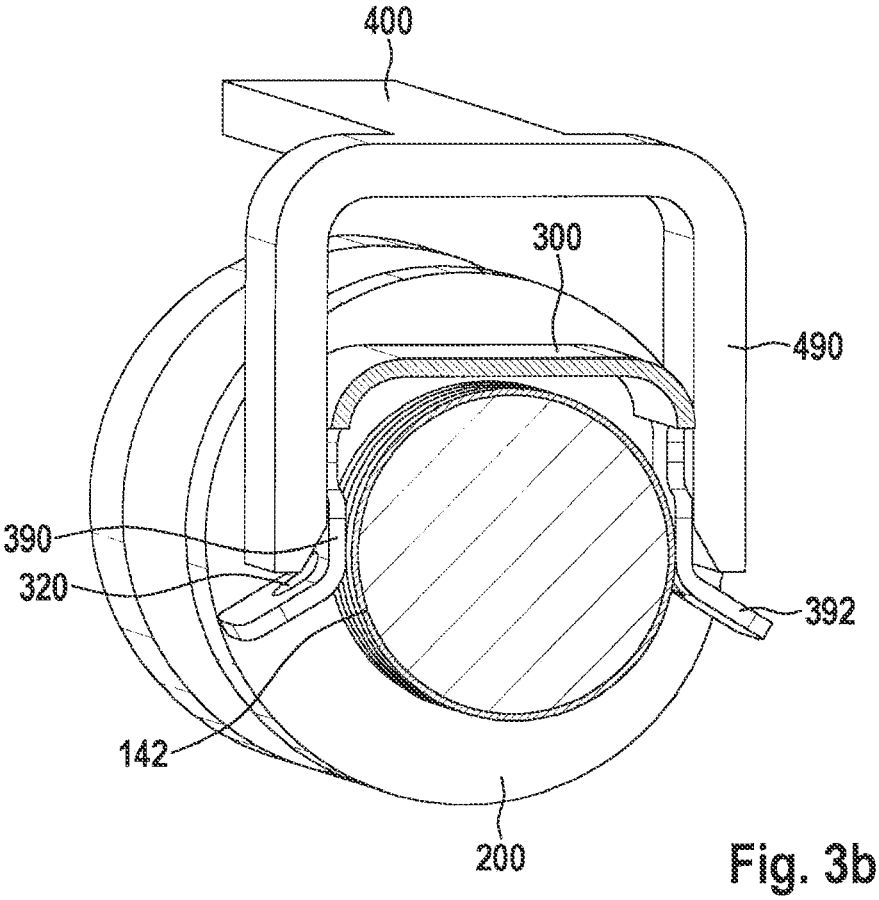
FIG. 3*b* shows a perspective view of a cross-section through an electrical contact system according to FIG. 3*a*, in the region of the contact region.

FIG. 3*b* shows the exemplary embodiment of FIG. 3*a* during the mounting process. Here, spring element 300 is pushed with its clamping arms 390 and its openings 320, including their cutting edges 322 in contact region 220, over line segment 142 fashioned as a coil. The spring element is surrounded by clamping jaws 490 of bus bar 400 and is clamped against line segment 142 on holding body 200. In the depicted mounted state, clamping jaws 490 are not yet pushed over spring clips 392. Through a further pushing of bus bar 400 with its clamping jaws 490 over spring clips 392, spring element 300 is tensioned between clamping jaws 490 and line segment 142 on holding body 200, cutting edges 322 of openings 320 of spring element 300 piercing the insulating layer of line segment 142 and thus ensuring an electrical and mechanical contact between the electrically conductive wire interiors of line segment 142 and spring element 300.

Figure 3C:
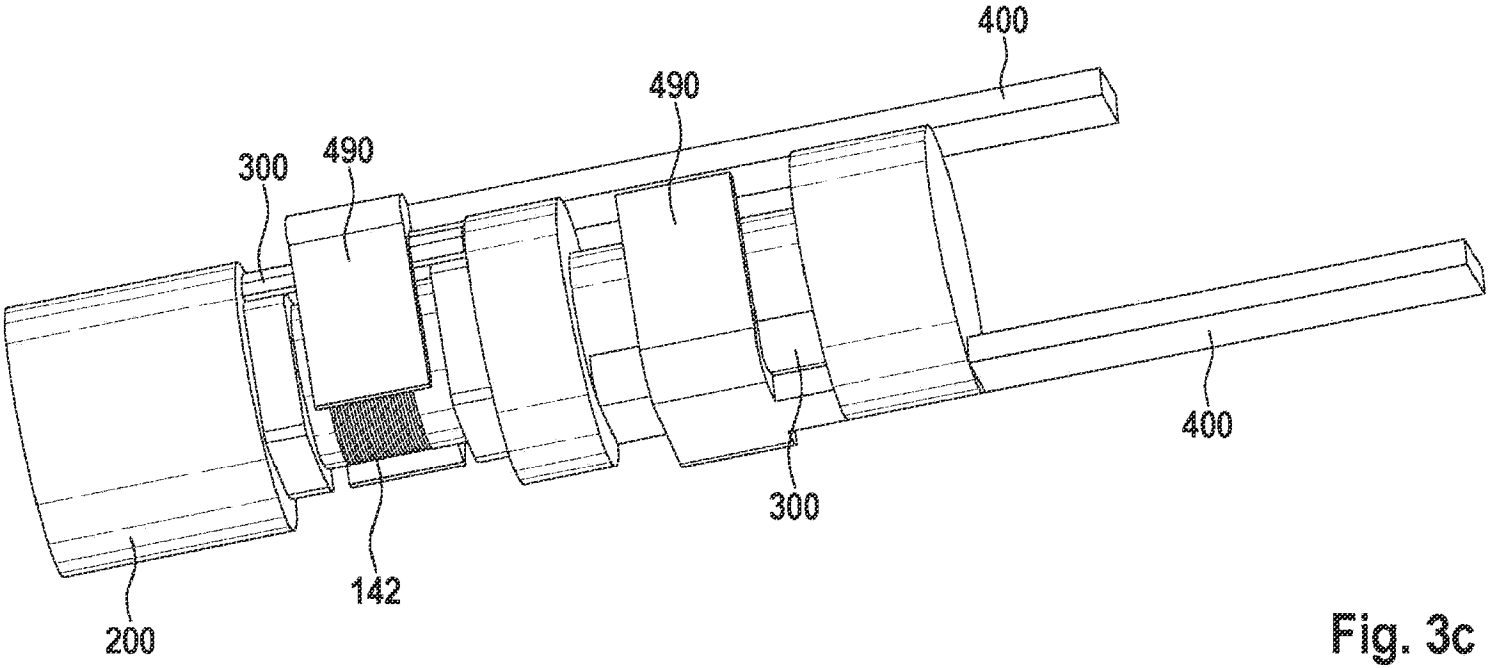
FIG. 3*c* shows a perspective representation of a contact system for contacting an electrical coil according to FIGS. 3*a* and 3*b*, in the mounted state.

FIG. 3*c* shows a contact system 100 according to the third exemplary embodiment of the present invention; in the depicted Figure, the two line segments 142 of coil 120 (not shown here) are contacted by two spring elements 300 and two bus bars 400. The two bus bars 400 and the respectively associated spring elements 300 are clamped on holding body 200 from opposite sides. An electrical contact system 100 produced in this way has a particularly secure contacting, because line segment 142 is wrapped around a holding body 200 in contact region 220 in a plurality of windings, and in this way the contact surface between spring element 300, its cutting edges 322, and line segment 142 is ensured over a particularly large surface. In addition, contact system 100 produced in this way can be mounted particularly easily by simply pushing clamping jaws 490 of bus bar 400 over clamping arms 390 of spring element 300 after clamping arms 390 of spring element have been previously pushed over line segment 142 in contact segment 220. Finally, the winding of electrical coil 120 (not shown here) and of contact regions 320 wound with line segment 142 is particularly easily possible, because during the winding process no imbalance caused by additional detachable mechanical parts can occur.

Spring elements 300 for all exemplary embodiments are preferably produced as metallic stamped flexible parts. In this way, in a particularly simple manner there result particularly sharp cutting edges 322. Cutting edges 322 on opening 320 in spring element 300 preferably have a bending radius RS that is significantly smaller than the radius of insulating layer RI of electrical wire 140. In this way, it is ensured that when spring element 300 is pressed on, via the bus bar 400, cutting edge 322 reliably pierces the insulating layer of line segment 142 and in this way ensures a reliable electrical and mechanical contact between spring element 300 and line segment 142.

Holding body 200 is preferably produced by an injection molding process in which thermoplastics and also thermosetting materials may be used. Bus bar 400 is preferably made of metal, particularly preferably of brass, bronze, steel, a steel alloy, copper, or aluminum. Bus bar 400 preferably has a galvanically refined surface, a so-called galvanic surface. The surface refinement of bus bar 400 in particular provides protection against corrosion. However, the bus bar can also be made of a conductive plastic, significantly reducing production costs.

Electrical contact system 100 according to the present invention is suitable for the contacting of coils 120, for example for use in a rotational speed sensor, preferably in an exhaust gas turbocharger. However, applications are also conceivable in the contacting of coils for actuators, such as magnetic valves, injectors, or electrical couplings operated with a coil. Electrical contact system 100 according to the present invention is suitable for use in particular for applications in the automotive field or in technical areas in which only a small constructive space is available.

What is claimed is:

1. An electrical contact system for contacting a coil, comprising:

a holding body, the holding body being electrically insulating;

a line segment of at least one electrical line, the electrical line being surrounded by an electrical insulating layer;

at least one spring element, wherein:

the spring element is electrically conductive, the spring element includes at least one opening, the opening forms a cutting edge in at least some regions of an edge of the opening, and the spring element is pressed with the cutting edge against the line segment in such a way that the cutting edge penetrates the electrical insulating layer and an electrical contact is produced between the spring element and the line segment; and at least one bus bar, wherein:

the bus bar is electrically conductive, at least one of the holding body and the bus bar includes a clamping arrangement, and the bus bar is fixedly clamped on the holding body by the clamping arrangement so that the spring element is tensioned between the bus bar and a contact region of the holding body, so that the line segment is electrically contacted with the bus bar by the spring element.

2. The electrical contact system as recited in claim 1, wherein the coil is a coil of a rotational speed sensor.

3. The electrical contact system as recited in claim 1, wherein:

the spring element includes a flexible spring formed from a metal strip, and the spring element immediately electrically contacts the at least one bus bar.

4. The electrical contact system as recited in claim 1, wherein the bus bar is detachably connected to the holding body.

5. The electrical contact system as recited in claim 1, wherein:

the contacting region includes a snap indentation opening having at least one snap indentation, the spring element includes at least one spring element snap nose, and the spring element engages, with the spring element snap nose, in the snap indentation opening, and grasps the snap indentation.

6. The electrical contact system as recited in claim 1, wherein the bus bar engages at its end in an opening of the spring element, forming a pivot bearing for the bus bar.

7. The electrical contact system as recited in claim 1, wherein:

the clamping arrangement on the holding body includes at least one pin, and the bas bar includes at least one socket-type opening in such a way that the pin is accommodated in the socket-type opening, forming a non-positive connection between the pin and the socket-type opening.

8. The electrical contact system as recited in claim 1, wherein:

the at least one spring element includes at least one flexible clip, the flexible clip is bent around the bus bar in such a way that the spring element is fixed on the bus bar.

9. The electrical contact system as recited in claim 1, wherein:

the spring element includes two clamping arms that stand out toward the holding body and that surround the holding body at least in some regions in the contact region, the clamping arms include ends having spring clips, the bus bar includes two clamping jaws that stand out toward the holding body, and the bus bar is pushed with its clamping jaws over the clamping arms of the spring element in such a way that the spring clips are tensioned between the clamping jaws and the holding body.

10. The electrical contact system as recited in claim 1, wherein one of:

the line segment is situated between the holding body and the spring element, and the line segment is situated between the spring element and the bus bar.

11. A use of an electrical contact system for contacting a coil, comprising a holding body, the holding body being electrically insulating; a line segment of at least one electrical line, the electrical line being surrounded by an electrical insulating layer; at least one spring element, wherein the spring element is electrically conductive, the spring element includes at least one opening, the opening forms a cutting edge in at least some regions of an edge of the opening, and the spring element is pressed with the cutting edge against the line segment in such a way that the cutting edge penetrates the electrical insulating layer and an electrical contact is produced between the spring element and the line segment; and at least one bus bar, wherein the bus bar is electrically conductive, at least one of the holding body and the bus bar includes a clamping arrangement, and the bus bar is fixedly clamped on the holding body by the clamping arrangement so that the spring element is tensioned between the bus bar and a contact region of the holding body, so that the line segment is electrically contacted with the bus bar by the spring element, the electrical contact system being used in a rotational speed sensor for acquiring a rotational speed in an exhaust gas turbocharger.

* * * * *